US011527230B2

(12) United States Patent
Inoue et al.

(10) Patent No.: US 11,527,230 B2
(45) Date of Patent: Dec. 13, 2022

(54) ACTIVE NOISE CONTROL DEVICE

(71) Applicant: HONDA MOTOR CO., LTD., Tokyo (JP)

(72) Inventors: Toshio Inoue, Wako (JP); Xun Wang, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 17/579,928

(22) Filed: Jan. 20, 2022

(65) Prior Publication Data

US 2022/0238092 A1 Jul. 28, 2022

(30) Foreign Application Priority Data

Jan. 22, 2021 (JP) ..... JP2021-008883

(51) Int. Cl.
*G10K 11/178* (2006.01)

(52) U.S. Cl.
CPC .. *G10K 11/17854* (2018.01); *G10K 11/17817* (2018.01); *G10K 11/17823* (2018.01); *G10K 11/17825* (2018.01); *G10K 11/17879* (2018.01); *G10K 2210/1282* (2013.01); *G10K 2210/3026* (2013.01); *G10K 2210/3027* (2013.01); *G10K 2210/3028* (2013.01); *G10K 2210/3044* (2013.01)

(58) Field of Classification Search
CPC ..... G10K 11/178; G10K 11/1781; G10K 11/17815; G10K 11/17817; G10K 11/1785; G10K 11/17853; G10K 11/17854; G10K 2210/3033; G10K 2210/3057
See application file for complete search history.

(56) References Cited

U.S. PATENT DOCUMENTS

2007/0222407 A1* 9/2007 Sakamoto ..... G05D 19/02 318/611
2008/0292110 A1 11/2008 Kobayashi et al.
2010/0098265 A1* 4/2010 Pan ..... G10K 11/17883 381/94.1

FOREIGN PATENT DOCUMENTS

JP 2008-239098 A 10/2008

* cited by examiner

*Primary Examiner* — Kile O Blair
(74) *Attorney, Agent, or Firm* — Carrier Blackman & Associates, P.C.; Joseph P. Carrier; Fulchand P. Shende

(57) ABSTRACT

An active noise control device includes a secondary path filter coefficient updating unit. The secondary path filter coefficient updating unit is configured to update a coefficient of a secondary path filter by using a coefficient of the secondary path filter after previous updating as a previous value, when a phase characteristic of the secondary path filter that sets an initial value as the coefficient and a phase characteristic of the secondary path filter that uses the previous value as the coefficient are not approximate to each other.

6 Claims, 10 Drawing Sheets

$\theta q < 15°$
$\theta r \geqq 15°$

ACTIVE NOISE CONTROL DEVICE

CROSS-REFERENCE TO RELATED APPLICATIONS

This application is based upon and claims the benefit of priority from Japanese Patent Application No. 2021-008883 filed on Jan. 22, 2021, the contents of which are incorporated herein by reference.

BACKGROUND OF THE INVENTION

Field of the Invention

The present invention relates to an active noise control device.

Description of the Related Art

JP 2008-239098 A discloses a technique of outputting a canceling sound from a speaker for canceling noise. Such noise is transmitted from a propeller shaft to a vehicle interior. A control signal for outputting the canceling sound from the speaker is generated by performing signal processing with an adaptive filter on a basic signal generated based on a rotational frequency of the propeller shaft. The adaptive filter is updated based on an error signal and the reference signal. The error signal is a signal output from a microphone provided in a vehicle compartment. The reference signal is a signal generated by correcting the basic signal with a correction value.

SUMMARY OF THE INVENTION

In the technique disclosed in JP 2008-239098 A, a transfer characteristic of the canceling sound between the speaker and the microphone is measured in advance, and the measured transfer characteristic is used as the correction value of the basic signal. Therefore, there is concern that the noise cannot be reduced when the transfer characteristic changes.

The present invention has been made to solve the above problem, and an object of the present invention is to provide an active noise control device that is capable of reducing noise even when transfer characteristic changes.

According to one aspect of the present invention, an active noise control device performs active noise control for controlling a speaker, based on an error signal that changes in accordance with a synthetic sound of noise transmitted from a vibration source and a canceling sound output from the speaker to cancel the noise, and includes a basic signal generating unit configured to generate a basic signal corresponding to a control target frequency, a control signal generating unit configured to perform signal processing on the basic signal by a control filter, which is an adaptive notch filter, to generate a control signal that controls the speaker, an estimated noise signal generating unit configured to perform signal processing on the basic signal by a primary path filter, which is an adaptive notch filter, to generate an estimated noise signal, a first estimated cancellation signal generating unit configured to perform signal processing on the control signal by a secondary path filter, which is an adaptive notch filter, to generate a first estimated cancellation signal, a first virtual error signal generating unit configured to generate a first virtual error signal from the error signal, the first estimated cancellation signal, and the estimated noise signal, a secondary path filter coefficient updating unit configured to sequentially and adaptively update a coefficient of the secondary path filter based on the control signal and the first virtual error signal in a manner that a magnitude of the first virtual error signal is minimized, and an initial value table configured to store an initial value of the coefficient of the secondary path filter in table form in association with a frequency, wherein the secondary path filter coefficient updating unit is configured to determine, before updating the coefficient of the secondary path filter, whether or not a phase characteristic of the secondary path filter when the initial value corresponding to the frequency in the initial value table is the coefficient of the secondary path filter and a phase characteristic of the secondary path filter after previous coefficient updating in the secondary path filter coefficient updating unit, are approximate to each other, update, when the phase characteristics are determined to be approximate, the coefficient of the secondary path filter by using the initial value as a previous value, and update, when the phase characteristics are determined not to be approximate, the coefficient of the secondary path filter by using the coefficient of the secondary path filter after the previous coefficient updating as a previous value by the secondary path filter coefficient updating unit.

The active noise control device according to the present invention is capable of reducing noise even when transfer characteristic changes.

The above and other objects, features, and advantages of the present invention will become more apparent from the following description when taken in conjunction with the accompanying drawings, in which a preferred embodiment of the present invention is shown by way of illustrative example.

BRIEF DESCRIPTION OF THE DRAWINGS

FIG. 2 is a block diagram of an active noise control device using a method that was proposed by the present inventors and the like;

DESCRIPTION OF THE INVENTION

First Embodiment

Figure 1:
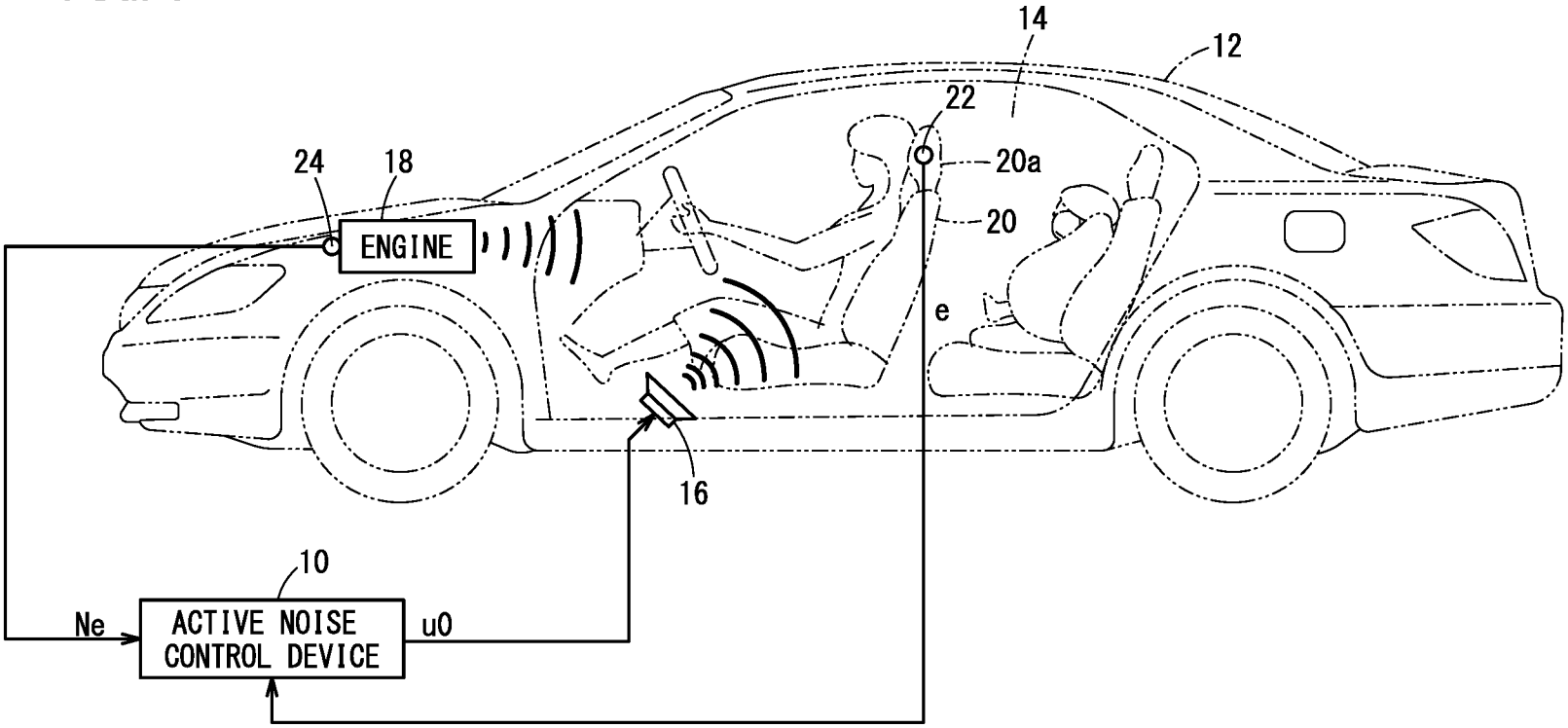
FIG. 1 is a diagram illustrating an outline of active noise control executed by an active noise control device.

FIG. 1 is a diagram illustrating an outline of active noise control executed by an active noise control device 10.

The active noise control device 10 outputs a canceling sound from a speaker 16 provided in a vehicle compartment 14 of a vehicle 12. The canceling sound cancels a muffled sound of an engine 18 (hereinafter referred to as noise) transmitted to a vehicle occupant due to vibration of the engine 18, thereby reducing the sound pressure of the noise. In the active noise control device 10, an error signal e and an engine rotational speed Ne are input. The error signal e is a signal output from a microphone 22 that detects cancellation error noise described later. The engine rotational speed Ne is a detection value detected by an engine rotational speed sensor 24. The active noise control device 10 generates a control signal u0 based on the error signal e and the engine rotational speed Ne. The active noise control device 10 outputs the control signal u0 to the speaker 16, and the speaker 16 outputs the canceling sound based on the control signal u0. The cancellation error noise is a synthesized sound of the canceling sound and the noise at a position of the microphone 22. The microphone 22 is provided on a headrest 20*a* of a seat 20 provided in the vehicle compartment 14. Thus, the microphone 22 is placed near the ears of the vehicle occupant.

Conventional Active Noise Control Device

Conventionally, an active noise control device using an adaptive notch filter (for example, a single-frequency adaptive notch (SAN) filter) having a small amount of computational processing has been proposed.

In the conventional active noise control device, first, a basic signal x having a frequency of noise to be canceled is generated. Hereinafter, the frequency of the noise to be canceled may be referred to as a control target frequency. Next, the active noise control device generates a control signal u0 by processing the basic signal x with a control filter W, which is an adaptive notch filter.

The control filter W is updated by an adaptive algorithm (for example, an LMS (Least Mean Square) algorithm) such that the error signal e output from the microphone 22 is minimized. As a result of cancellation of the noise by the canceling sound, the sound pressure of the sound input to the microphone 22 decreases, and then the error signal e also decreases.

A transfer characteristic C is present in a sound transfer path from the speaker 16 to the microphone 22. The phase of the canceling sound output from the speaker 16 is different from that of the canceling sound input to the microphone 22. In order to cancel the noise by the canceling sound at the position of the microphone 22, it is necessary to output the canceling sound from the speaker 16 in consideration of the phase of the canceling sound input to the microphone 22. The speaker 16 outputs the canceling sound based on the control signal u0. The control signal u0 is a signal processed by the control filter W. The conventional active noise control device identifies the transfer characteristic C as a filter Cˆ in advance. Then, the conventional active noise control device updates the control filter W using the basic signal x processed by the filter Cˆ. Such control is called a filtered-x type. The transfer characteristic C includes an electronic circuit characteristic of the speaker 16 and an electronic circuit characteristic of the microphone 22.

The filter Cˆ is a fixed filter identified in advance. Thus, when the transfer characteristic C has been changed, the phase characteristic of the filter Cˆ and the phase characteristic of the transfer characteristic C may be significantly deviated from each other. In this case, there is concern that when the control filter W is updated, the control filter W may diverge. In addition, the canceling sound output from the speaker 16 may amplify noise, and the canceling sound output from the speaker 16 may become an abnormal sound undesirably.

Therefore, the inventors of the present invention have proposed a method in which the filter Cˆ to follow a change in the transfer characteristic C during active noise control, without the need for identifying the transfer characteristic C in advance. The present invention is a further improvement of the method that was already proposed by the present inventors. An active noise control device 100 using the method already proposed by the present inventors will be schematically described below.

Figure 2:
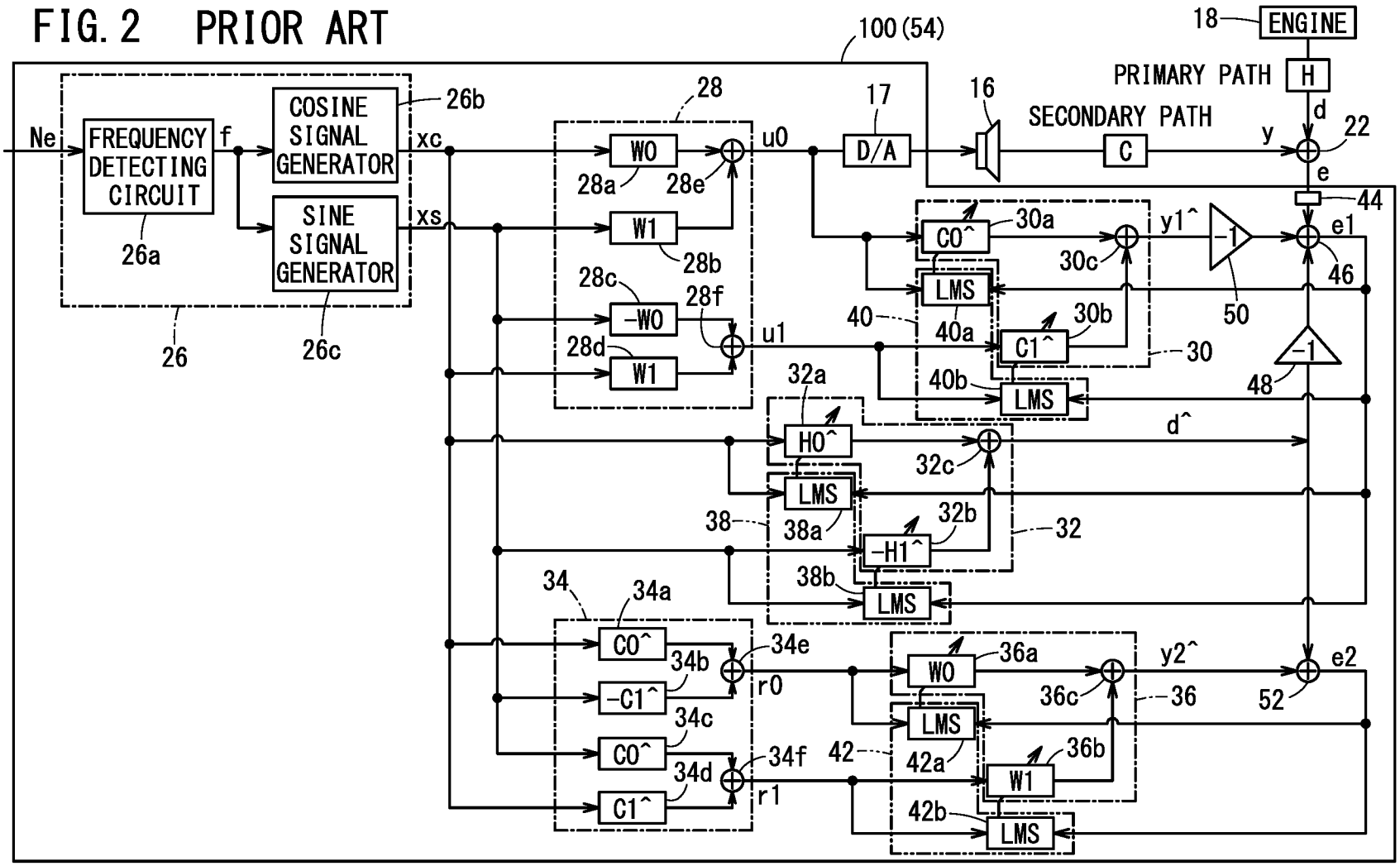
FIG. 2 PRIOR ART

FIG. 2 is a block diagram of the active noise control device 100 using the method proposed by the present inventors. The transfer path of the sound from the engine 18 to the microphone 22 is hereinafter referred to as a primary path. Further, the transfer path of the sound from the speaker 16 to the microphone 22 is hereinafter referred to as a secondary path.

The active noise control device 100 includes a basic signal generating unit 26, a control signal generating unit 28, a first estimated cancellation signal generating unit 30, an estimated noise signal generating unit 32, a reference signal generating unit 34, a second estimated cancellation signal generating unit 36, a primary path filter coefficient updating unit 38, a secondary path filter coefficient updating unit 40, and a control filter coefficient updating unit 42.

The basic signal generating unit 26 generates basic signals xc and xs based on the engine rotational speed Ne. The basic signal generating unit 26 includes a frequency detecting circuit 26*a*, a cosine signal generator 26*b*, and a sine signal generator 26*c*.

The frequency detecting circuit 26*a* detects a control target frequency f. The control target frequency f is a vibration frequency of the engine 18 detected based on the engine rotational speed Ne. The cosine signal generator 26*b* generates the basic signal xc (=cos(2πft)) which is a cosine signal of the control target frequency f. The sine signal generator 26*c* generates the basic signal xs (=sin(2πft)) which is a sine signal of the control target frequency f. Here, t is time.

The control signal generating unit 28 generates control signals u0 and u1 based on the basic signals xc and xs. The control signal generating unit 28 includes a first control filter 28*a*, a second control filter 28*b*, a third control filter 28*c*, a fourth control filter 28*d*, an adder 28*e*, and an adder 28*f*.

The control signal generating unit 28 performs signal processing on the reference signals xc and xs using the control filter W, which is a SAN filter. The control filter W has a filter W0 for the reference signal xc and a filter W1 for the reference signal xs. The control filter W is optimized by updating the coefficient W0 of the filter W0 and the coefficient W1 of the filter W1 in the control filter coefficient updating unit 42 described later.

The first control filter 28*a* has the filter coefficient W0. The second control filter 28*b* has the filter coefficient W1. The third control filter 28*c* has a filter coefficient −W0. The fourth control filter 28*d* has a filter coefficient W1.

The basic signal xc processed by the first control filter 28*a* and the basic signal xs processed by the second control filter 28*b* are added by the adder 28*e* to generate the control signal u0. The basic signal xs processed by the third control filter 28*c* and the basic signal xc processed by the fourth control filter 28*d* are added by the adder 28*f* to generate the control signal u1.

The control signal u0 is converted into an analog signal by a digital-to-analog converter 17 and output to the speaker 16. The speaker 16 outputs a canceling sound based on the control signal u0.

The first estimated cancellation signal generating unit 30 generates first estimated cancellation signal y1ˆ based on the control signals u0 and u1. The first estimated cancellation signal generating unit 30 includes a first secondary path filter 30*a*, a second secondary path filter 30*b*, and an adder 30*c*.

The first estimated cancellation signal generating unit 30 performs signal processing on the control signals u0 and u1 using the secondary path filter Cˆ, which is a SAN filter. The coefficients (C0ˆ+iC1ˆ) of the secondary path filter Cˆ are updated by the secondary path filter coefficient updating unit 40 to be described later, whereby the secondary path transfer characteristic C is identified as the secondary path filter Cˆ.

The filter coefficient of the first secondary path filter 30*a* is a real part C0ˆ of the coefficient of the secondary path filter Cˆ. The filter coefficient of the second secondary path filter 30*b* is an imaginary part C1ˆ of the coefficient of the secondary path filter Cˆ. The control signal u0 processed by the first secondary path filter 30*a* and the control signal u1 processed by the second secondary path filter 30*b* are added by the adder 30*c* to generate the first estimated cancellation signal y1ˆ. The first estimated cancellation signal y1ˆ is an estimation signal corresponding to the canceling sound y input to the microphone 22.

The estimated noise signal generating unit 32 generates an estimated noise signal dˆ based on the basic signals xc and xs. The estimated noise signal generating unit 32 includes a first primary path filter 32*a*, a second primary path filter 32*b*, and an adder 32*c*.

The estimated noise signal generating unit 32 performs signal processing on the basic signal xc using a primary path filter Hˆ that is a SAN filter. The coefficients (H0ˆ+iH1ˆ) of the primary path filter Hˆ are updated by the primary path filter coefficient updating unit 38 to be described later, whereby the transfer characteristic H of the primary path is identified as the primary path filter Hˆ. Hereinafter, the transfer characteristic H of the primary path is referred to as a primary path transfer characteristic H.

The filter coefficient of the first primary path filter 32*a* is a real part H0ˆ of the coefficient of the primary path filter Hˆ. The filter coefficient of the second primary path filter 32*b* is a −H1ˆ obtained by inverting the polarity of the imaginary part of the coefficient of the primary path filter Hˆ. The basic signal xc on which signal processing has been performed by the first primary path filter 32*a* and the basic signal xs on which signal processing has been performed by the second primary path filter 32*b* are added by the adder 32*c* to generate an estimated noise signal dˆ. The estimated noise signal dˆ is an estimated signal corresponding to the noise d input to the microphone 22.

The reference signal generating unit 34 generates reference signals r0 and r1 based on the basic signals xc and xs. The reference signal generating unit 34 includes a third secondary path filter 34*a*, a fourth secondary path filter 34*b*, a fifth secondary path filter 34*c*, a sixth secondary path filter 34*d*, an adder 34*e*, and an adder 34*f*.

The reference signal generating unit 34 performs signal processing on the basic signals xc and xs using a secondary path filter Cˆ, which is a SAN filter. The coefficients (C0ˆ+iC1ˆ) of the secondary path filter Cˆ are updated by the secondary path filter coefficient updating unit 40 to be described later, whereby the secondary path transfer characteristic C is identified as the secondary path filter Cˆ. Hereinafter, the transfer characteristic C of the secondary path is referred to as a secondary path transfer characteristic C.

The filter coefficient of the third secondary path filter 34*a* is a real part C0ˆ of the coefficient of the secondary path filter Cˆ. The filter coefficient of the fourth secondary path filter 34*b* is −C1ˆ obtained by inverting the polarity of the imaginary part of the coefficient of the secondary path filter Cˆ. The filter coefficient of the fifth secondary path filter 34*c* is a real part C0ˆ of the coefficient of the secondary path filter Cˆ. The filter coefficient of the sixth secondary path filter 34*d* is an imaginary part C1ˆ of the coefficient of the secondary path filter Cˆ.

The basic signal xc on which signal processing has been performed by the third secondary path filter 34*a* and the basic signal xs on which signal processing has been performed by the fourth secondary path filter 34*b* are added by the adder 34*e* to generate the reference signal r0. The basic signal xs on which signal processing has been performed by the fifth secondary path filter 34*c* and the basic signal xc on which signal processing has been performed by the sixth secondary path filter 34*d* are added by the adder 34*f* to generate the reference signal r1.

The second estimated cancellation signal generating unit 36 generates a second estimated cancellation signal y2ˆ based on the reference signals r0 and r1. The second estimated cancellation signal generating unit 36 includes a fifth control filter 36*a*, a sixth control filter 36*b*, and an adder 36*c*.

The second estimated cancellation signal generating unit 36 performs signal processing on the reference signals r0 and r1 using the control filter W, which is a SAN filter. The filter coefficient of the fifth control filter 36*a* is W0. The filter coefficient of the sixth control filter 36*b* is W1.

The reference signal r0 on which signal processing has been performed by the fifth control filter 36*a* and the reference signal r1 on which signal processing has been performed by the sixth control filter 36*b* are added by the adder 36*c* to generate the second estimated cancellation signal y2ˆ. The second estimated cancellation signal y2ˆ is an estimation signal corresponding to the canceling sound y input to the microphone 22.

The analog-to-digital converter 44 converts the error signal e output from the microphone 22 from an analog signal to a digital signal.

The error signal e is input to an adder 46. The polarity of the estimated noise signal dˆ generated by the estimated noise signal generating unit 32 is inverted by an inverter 48. The estimated noise signal −dˆ whose polarity is inverted is input to the adder 46. The polarity of the first estimated cancellation signal y1ˆ generated by the first estimated cancellation signal generating unit 30 is inverted by an inverter 50. The first estimated cancellation signal −y1ˆ whose polarity is inverted is input to the adder 46. The estimated noise signal −dˆ and the first estimated cancellation signals −yˆ are added by the adder 46 to generate a first virtual error signal e1. The adder 46 corresponds to a first virtual error signal generating unit of the present invention.

The estimated noise signal dˆ generated by the estimated noise signal generating unit 32 is input to an adder 52. The second estimated cancellation signal y2ˆ generated by the second estimated cancellation signal generating unit 36 is input to the adder 52. The estimated noise signal dˆ and the second estimated cancellation signal y2ˆ are added by the adder 52 to generate the second virtual error signal e2. The adder 52 corresponds to a second virtual error signal generating unit of the present invention.

The primary path filter coefficient updating unit 38 sequentially and adaptively updates the coefficient of the primary path filter H" based on the LMS algorithm such that the magnitude of the first virtual error signal el is minimized. The primary path filter coefficient updating unit 38 includes a first primary path filter coefficient updating unit 38*a* and a second primary path filter coefficient updating unit 38*b*.

The first primary path filter coefficient updating unit 38*a* and the second primary path filter coefficient updating unit 38*b* update the filter coefficients H0ˆ and H1ˆ based on the following expressions. In the expressions, n denotes the time step (n=0, 1, 2 . . . ) and μ0 and μ1 denote the step size parameters.

$$H0^{\wedge}_{n+1}=H0^{\wedge}_{n}-\mu 0\times e1_{n}\times xc_{n}$$

$$H1^{\wedge}_{n+1}=H1^{\wedge}_{n}-\mu 1\times e1_{n}\times xs_{n}$$

The primary path transfer characteristic H is identified as the primary path filter Hˆ by repeatedly updating the filter coefficients H0ˆ and H1ˆ by the primary path filter coefficient updating unit 38. In the active noise control device 100 using the SAN filter, the update expression for the coefficient of primary path filter Hˆ is configured by four arithmetic operations and does not include a convolution operation. Therefore, it is possible to suppress a computation load due to update processing of the filter coefficients H0ˆ and H1ˆ.

The secondary path filter coefficient updating unit 40 sequentially and adaptively updates the coefficient of the secondary path filter Cˆ based on the LMS algorithm such that the magnitude of the first virtual error signal e1 is minimized. The secondary path filter coefficient updating unit 40 includes a first secondary path filter coefficient updating unit 40*a* and a second secondary path filter coefficient updating unit 40*b*.

The first secondary path filter coefficient updating unit 40*a* and the second secondary path filter coefficient updating unit 40*b* update the filter coefficients C0ˆ and C1ˆ based on the following expressions. In the expressions, μ2 and μ3 indicate step size parameters.

$$C0^{\wedge}_{n+1}=C0^{\wedge}_{n}-\mu 2\times e1_{n}\times u0_{n}$$

$$C1^{\wedge}_{n+1}=C1^{\wedge}_{n}-\mu 3\times e1_{n}\times u1_{n}$$

The secondary path transfer characteristic C is identified as the secondary path filter Cˆ by repeatedly updating the filter coefficients C0ˆ and C1ˆ by the secondary path filter coefficient updating unit 40. In the active noise control device 100 using the SAN filter, the update expressions for the filter coefficients C0ˆ and C1ˆ are configured by four arithmetic operations and do not include a convolution operation. Therefore, it is possible to suppress a computation load due to update processing of filter coefficients C0ˆ and C1ˆ.

The control filter coefficient updating unit 42 sequentially and adaptively updates the coefficients W0 and W1 of the control filter W based on the LMS algorithm such that the magnitude of the second virtual error signal e2 is minimized. The control filter coefficient updating unit 42 includes a first control filter coefficient updating unit 42*a* and a second control filter coefficient updating unit 42*b*.

The first control filter coefficient updating unit 42*a* and the second control filter coefficient updating unit 42*b* update the filter coefficients W0 and W1 based on the following expressions. In the expressions, μ4 and μ5 denote the step size parameters.

$$W0_{n+1}=W0_{n}-\mu 4\times e2_{n}\times r0_{n}$$

$$W1_{n+1}=W1_{n}-\mu 5\times e2_{n}\times r1_{n}$$

The control filter W is optimized by repeatedly updating the filter coefficients W0 and W1 by the control filter coefficient updating unit 42. In the active noise control device 100 using the SAN filter, the update expressions for the filter coefficients W0ˆ and W1ˆ are configured by four arithmetic operations and do not include a convolution operation. Therefore, it is possible to suppress a computation load due to update processing of filter coefficients W0ˆ and W1ˆ.

Improvements

Improvements made in the present invention will be described, with respect to the active noise control device 100 using the technique that was already proposed by the present inventors.

Figure 3:
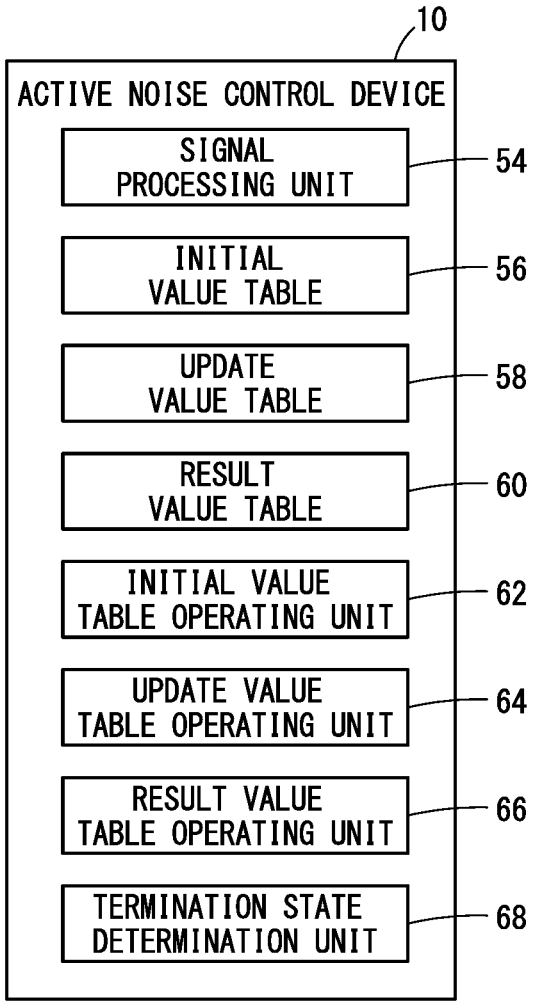
FIG. 3 is a block diagram of the active noise control device.

FIG. 3 is a block diagram of the active noise control device 10 according to the present embodiment. The active noise control device 10 according to the present embodiment includes, as a signal processing unit 54, the active noise control device 100 using a method that was already proposed by the present inventors. The active noise control device 10 further includes an initial value table 56, an update value table 58, a result value table 60, an initial value table operating unit 62, an update value table operating unit 64, a result value table operating unit 66, and an termination state determination unit 68.

The active noise control device 10 includes an operational processing device and a storage unit (not shown). The operational processing device includes, for example, a processor such as a central processing unit (CPU) or a microprocessing unit (MPU), and a memory such as a ROM or a RAM. The storage unit is, for example, a hard disk, a flash memory, or the like. The active noise control device 10 need not necessarily have a storage unit. Data may be transmitted and received by communications between the active noise control device 10 and the storage space on the cloud. The signal processing unit 54, the initial value table operating unit 62, the update value table operating unit 64, the result value table operating unit 66, and the termination state determination unit 68 are realized by the operational processing unit executing a program stored in the storage unit.

The initial value table 56 is a memory area in table form provided in the ROM. Initial values of the filter coefficients C0ˆ and C1ˆ of a secondary path filter Cˆ, which will be described later, are stored in the initial value table 56. The update value table 58 is a memory area in table form provided in the RAM. The update values of the filter coefficients C0ˆ and C1ˆ are stored in the update value table 58. The result value table 60 is a memory area in table form provided in the ROM. The result values of the filter coefficients C0ˆ and C1ˆ are stored in the result value table 60.

The initial value table operating unit 62 writes initial values in the initial value table 56, or performs other operations. The update value table operating unit 64 writes update values in the update value table 58, or performs other operations. The result value table operating unit 66 writes result values in the result value table 60, or performs other operations.

The termination state determination unit 68 determines a cause for termination of active noise control. There are three causes for the termination of active noise control. The first one is a normal termination due to stopping of the engine 18, the second one is an abnormal termination due to occurrence of an abnormality in the active noise control, and the third one is a divergence termination due to divergence of the active noise control.

The update processing of the filter coefficients C0ˆ and C1ˆ by the secondary path filter coefficient updating unit 40 of the present embodiment is partially different from the update processing of the filter coefficients C0ˆ and C1ˆ by the secondary path filter coefficient updating unit 40 of the above-described active noise control device 100.

First, in the present embodiment, the secondary path filter coefficient updating unit 40 performs determination described below, before updating the filter coefficients C0ˆ and C1ˆ. The secondary path filter coefficient updating unit 40 determines whether or not the phase characteristic of the secondary path filter Cˆ after the previous coefficient updating and the phase characteristic of the secondary path filter Cˆ having the update value as the coefficient are approximate to each other. Since this determination is performed before the filter coefficients C0ˆ and C1ˆ are updated, the secondary path filter Cˆ after the previous coefficient updating can be referred to as the current secondary path filter Cˆ. The update value corresponds to the control target frequency f obtained from the current engine rotational speed Ne. This update value is stored in the update value table 58 of FIG. 6 described later. Hereinafter, the secondary path filter Cˆ after the previous coefficient updating may be referred to as a previous value secondary path filter Cˆ. Further, the secondary path filter Cˆ having, as a coefficient, an update value corresponding to the control target frequency f obtained from the current engine rotational speed Ne may be referred to as an update value secondary path filter Cˆ.

When the phase difference θ between the phase characteristic of the previous value secondary path filter Cˆ and the phase characteristic of the update value secondary path filter Cˆ is less than 15°, the secondary path filter coefficient updating unit 40 determines that the phase characteristics of the two are approximate to each other. When the phase difference θ between the phase characteristic of the previous value secondary path filter Cˆ and the phase characteristic of the update value secondary path filter Cˆ is equal to or larger than 15°, the secondary path filter coefficient updating unit 40 determines that the phase characteristics of the two are not approximate to each other.

Figure 4:
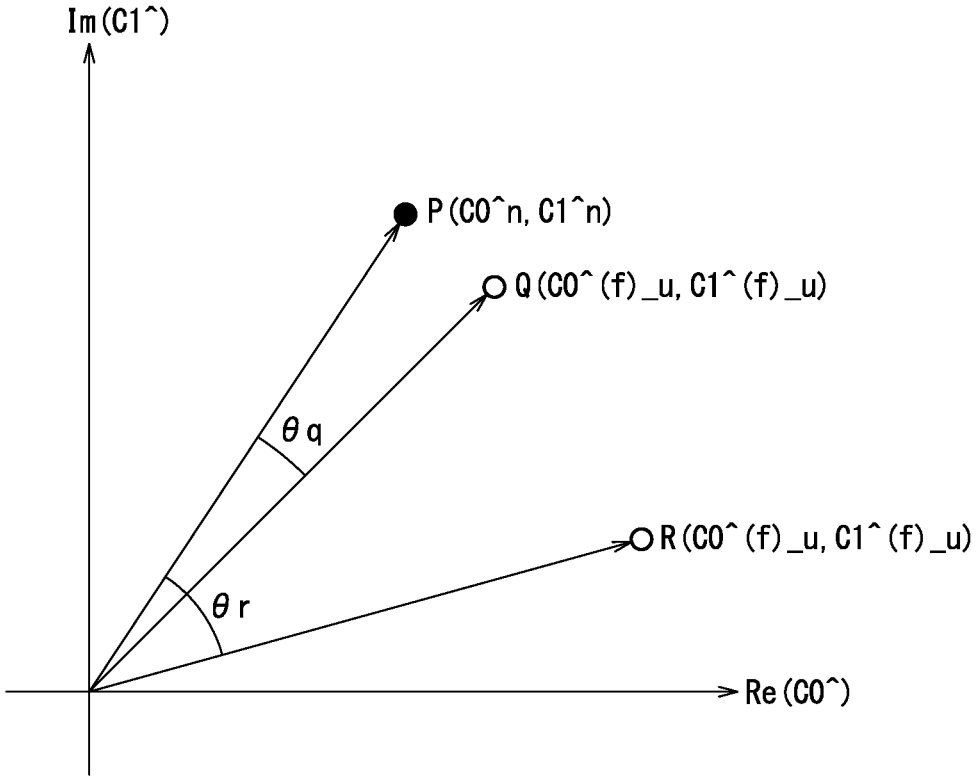
FIG. 4 is a diagram illustrating a secondary path filter on a complex plane.

FIG. 4 shows a secondary path filter Cˆ on a complex plane. A point P indicates the position of the previous value secondary path filter Cˆ. Points Q and R indicate the positions of the update value secondary path filter Cˆ. The phase difference θ can be obtained based on the following expression.

$$\theta = cos^{-1}\frac{C0\hat{}_n \cdot C0\hat{}(f)_u + C1 \cdot C1\hat{}(f)_u}{\left(\sqrt{C0\hat{}_n^2 + C1\hat{}_n^2}\right)\cdot\left(\sqrt{C0\hat{}(f)_u^2 + C1\hat{}(f)_u^2}\right)}$$

In the filter coefficients C0ˆn and C1ˆn of the above expression, the filter coefficients C0ˆ and C1ˆ of the previous value secondary path filter Cˆ are input, respectively. The filter coefficients C0ˆ and C1ˆ of the update value secondary path filter Cˆ are input to C0ˆ(f)_u and C1ˆ(f)_u in the above expression, respectively.

For example, when the update value secondary path filter Cˆ is located at the point Q shown in FIG. 4, the phase difference θq between the update value secondary path filter Cˆ and the previous value secondary path filter Cˆ is less than 15°. Therefore, the secondary path filter coefficient updating unit 40 determines that the phase characteristic of the previous value secondary path filter Cˆ and the phase characteristic of the update value secondary path filter Cˆ are approximate to each other.

For example, when the update value secondary path filter Cˆ is located at a point R illustrated in FIG. 4, the phase difference θr between the update value secondary path filter Cˆ and the previous value secondary path filter Cˆ is 15° or more. Therefore, the secondary path filter coefficient updating unit 40 determines that the phase characteristic of the previous value secondary path filter Cˆ and the phase characteristic of the update value secondary path filter Cˆ are not approximate to each other.

Whether or not the phase characteristic of the previous value secondary path filter Cˆ and the phase characteristic of the updated secondary path filter Cˆ are approximate to each other may be determined as follows.

Figure 5:
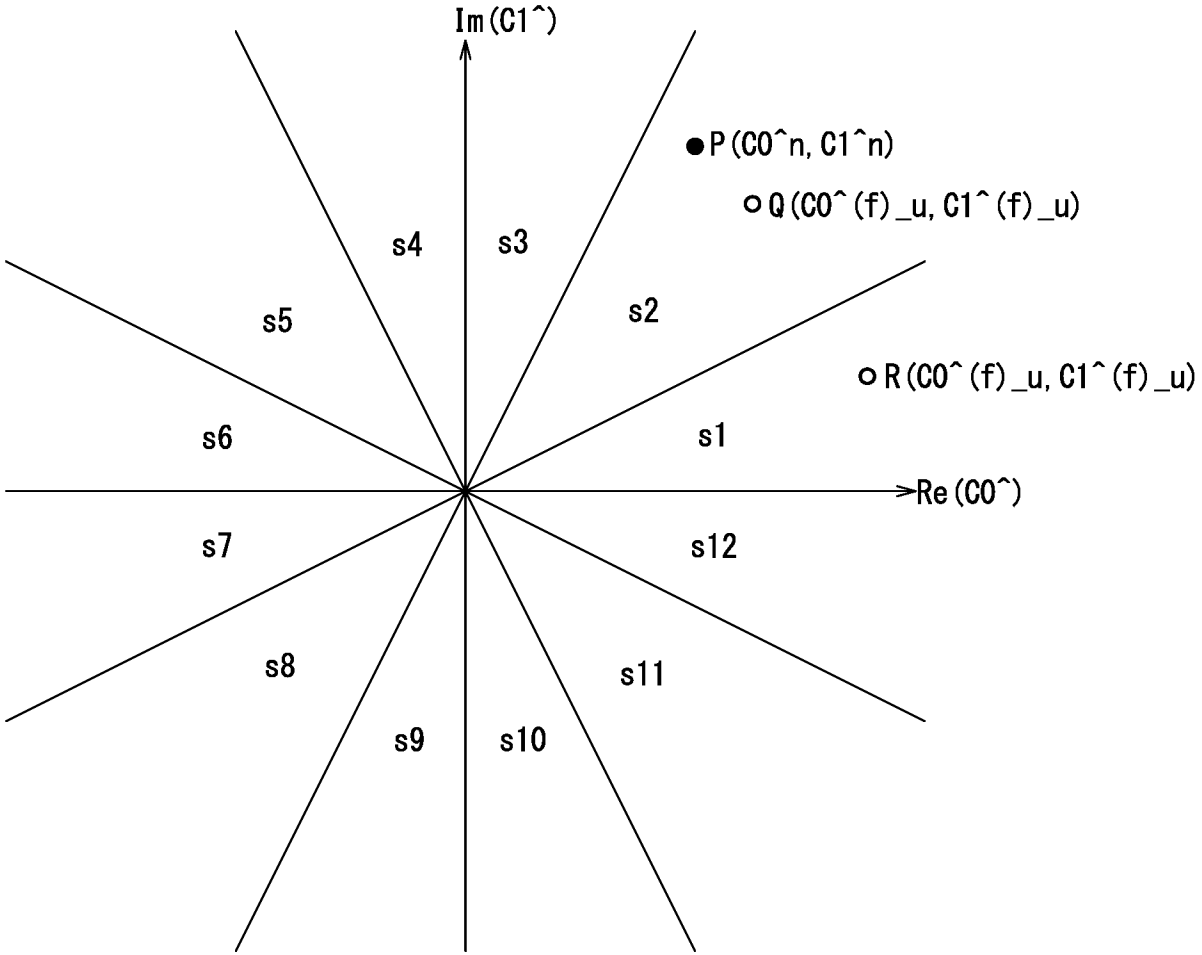
FIG. 5 is a diagram illustrating a secondary path filter on a complex plane.

FIG. 5 is a diagram showing a secondary path filter Cˆ on a complex plane. As shown in FIG. 5, the complex plane is divided into 12 regions from S1 to S12 at every predetermined angle of 30°.

When the update value secondary path filter Cˆ and the previous value secondary path filter Cˆ are located in the same region, the secondary path filter coefficient updating unit 40 determines that the phase characteristics of the update value secondary path filter Cˆ and the previous value secondary path filter Cˆ are approximate to each other. When the update value secondary path filter Cˆ and the previous value secondary path filter Cˆ are located in different regions, the secondary path filter coefficient updating unit 40 determines that the phase characteristics of the update value secondary path filter Cˆ and the previous value secondary path filter Cˆ are not approximate to each other.

For example, when the update value secondary path filter Cˆ is located at a point Q shown in FIG. 5, the point Q is located in the same region S2 as the point P which is the position of the previous value secondary path filter Cˆ. Therefore, the secondary path filter coefficient updating unit 40 determines that the phase characteristic of the previous value secondary path filter Cˆ and the phase characteristic of the update value secondary path filter Cˆ are approximate to each other.

For example, when the update value secondary path filter Cˆ is located at a point R illustrated in FIG. 5, the point R is located in a region S1 different from the region SL of the point P which is the position of the previous value secondary path filter Cˆ. Therefore, the secondary path filter coefficient updating unit 40 determines that the phase characteristic of the previous value secondary path filter Cˆ and the phase characteristic of the update value secondary path filter Cˆ are not approximate to each other.

When it is determined that the phase characteristic of the previous value secondary path filter Cˆ and the phase characteristic of the update value secondary path filter Cˆ are approximate to each other, the secondary path filter coefficient updating unit 40 according to the present embodiment performs the following processing. That is, the first secondary path filter coefficient updating unit 40*a* provided in the secondary path filter coefficient updating unit 40 and the second secondary path filter coefficient updating unit 40*b* provided in the secondary path filter coefficient updating unit 40 respectively update the filter coefficients C0ˆ and C1ˆ based on the following expressions.

$$C0\hat{}(f)_{n+1} = C0\hat{}(f)_u - \mu 2 \times e1_n \times u0_n$$

$$C1\hat{}(f)_{n+1} = C1\hat{}(f)_u - \mu 3 \times e1_n \times u1_n$$

Update values C0ˆ(f)_u and C1ˆ(f)_u corresponding to the control target frequency f are input to the first term (hereinafter referred to as a "pre-update value") of the right side of each of the above expressions. The control target frequency f is a control target frequency f obtained from the engine rotational speed Ne at the time of the current update (time step n+1). Among the filter coefficients C0ˆ and C1ˆ in which the engine rotational speed Ne at the time of updating is the same as the engine rotational speed Ne at the time of current updating, the filter coefficients C0ˆ and C1ˆ having the latest update time point are input to the pre-update values.

When it is determined that the phase characteristic of the previous value secondary path filter Cˆ and the phase characteristic of the update value secondary path filter Cˆ are not approximate to each other, the secondary path filter coefficient updating unit 40 according to the present embodiment updates the filter coefficients C0ˆ and C1ˆ in the first secondary path filter coefficient updating unit 40*a* and the second secondary path filter coefficient updating unit 40*b* based on the following expressions.

$$C0\hat{}_{n+1}C0\hat{}_{n}-\mu 2\times e1_{n}\times u0_{n}$$

$$C1\hat{}_{n+1}=C1\hat{}_{n}-\mu 3\times e1_{n}\times u1_{n}$$

The filter coefficients C0ˆn and C1ˆn updated at the previous update (time step n) are input to the pre-update values of the above expressions. In this case, the filter coefficients C0ˆ and C1ˆ having the latest update time point among the filter coefficients C0ˆ and C1ˆ updated in the past are input to the pre-update values. The engine rotational speed Ne at the time when the filter coefficients C0ˆ and C1ˆ input to the pre-update values are updated is different from the engine rotational speed Ne at the time of the current update.

The secondary path filter coefficient updating unit 40 sets the updated filter coefficients C0ˆ and C1ˆ as the filter coefficients of the third secondary path filter 34*a*, the fourth secondary path filter 34*b*, the fifth secondary path filter 34*c*, and the sixth secondary path filter 34*d* of the reference signal generating unit 34.

Update of Filter Coefficient of Secondary Path Filter

Figure 6:
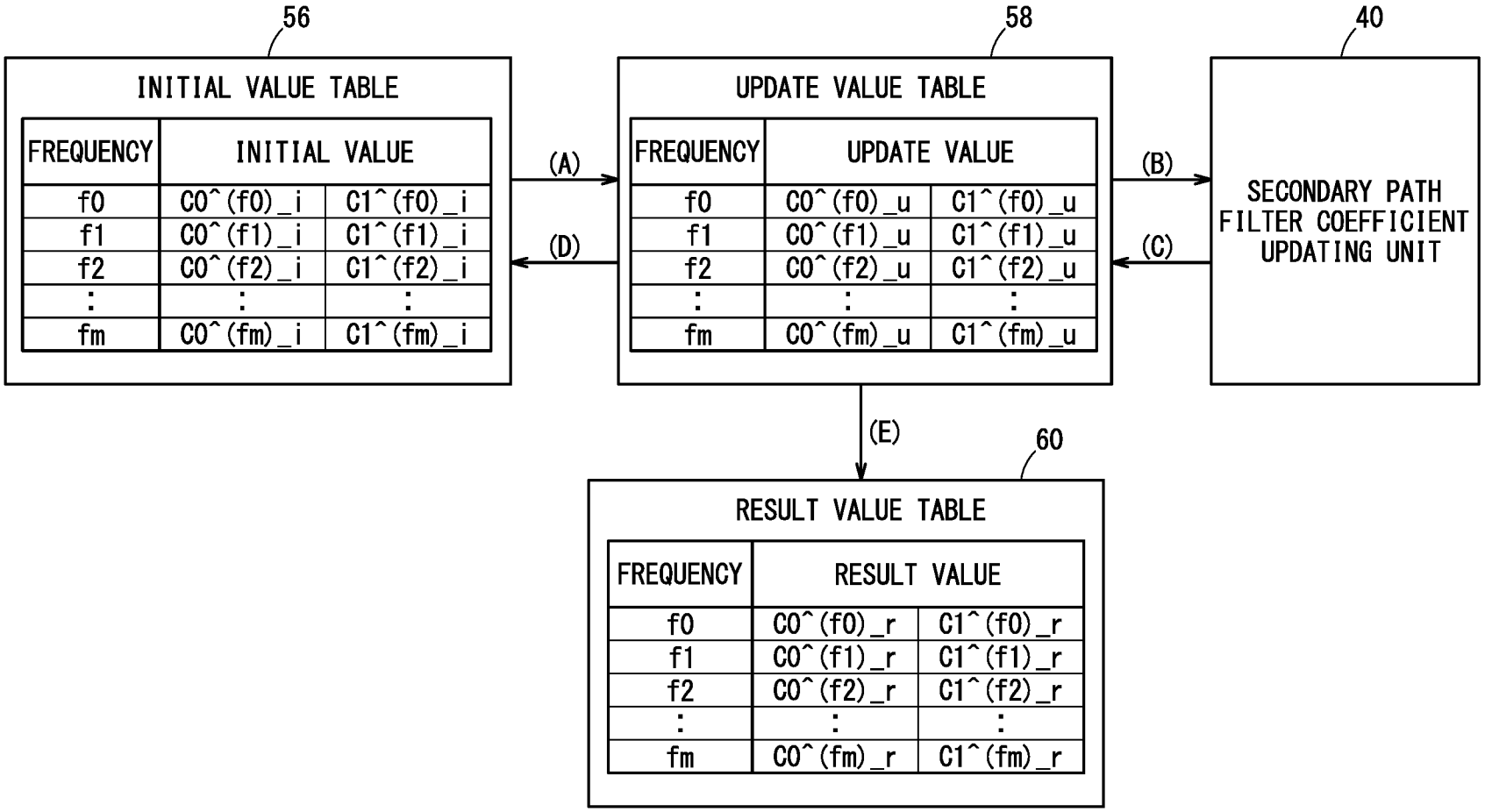
FIG. 6 is a diagram illustrating a table.

FIG. 6 is a diagram illustrating the table. As shown in FIG. 6, the initial value table 56 stores initial values C0ˆ(f)_i and C1ˆ(f)_i in table form. The initial values C0ˆ(f)_i and C1ˆ(f)_i are stored in the initial value table 56 in association with frequencies. As shown in FIG. 6, the update value table 58 stores the update values C0ˆ(f)_u and C1ˆ(f)_u in table form. The update values C0ˆ(f)_u and C1ˆ(f)_u are stored in the update value table 58 in association with frequencies. As shown in FIG. 6, the result value table 60 stores the result values C0ˆ(f)_r and C1ˆ(f)_r in table form. The result values C0ˆ(f)_r and C1ˆ(f)_r are associated with frequencies and stored in the result value table 60.

The initial values C0ˆ(f)_i and C1ˆ(f)_i stored in the initial value table 56 are set based on any of the following (i) to (vi).

(i) A measured value of the secondary path transfer characteristic C at each frequency;

(ii) A phase characteristic of a measured value of the secondary path transfer characteristic C at each frequency;

(iii) An estimated value of the secondary path transfer characteristic C complemented on the basis of measured values of the secondary path transfer characteristics C at representative frequencies;

(iv) A phase characteristic of an estimated value of the secondary path transfer characteristic C complemented based on measured values of the secondary path transfer characteristics C at representative frequencies;

(v) An estimated value of the secondary path transfer characteristic C estimated by the following expressions:

$$C0\hat{}(f)=\alpha(f)\times\cos(-2\pi fT)$$

$$C1\hat{}(f)=\alpha(f)\times\sin(-2\pi fT)$$

Here, T is the time until the sound reaches the microphone 20 from the speaker 16, and a is an amplitude constant; and (vi) A convenient small value (in a case where an initial value is not particularly set for convenience such as efficiency of system setting).

Figure 7:
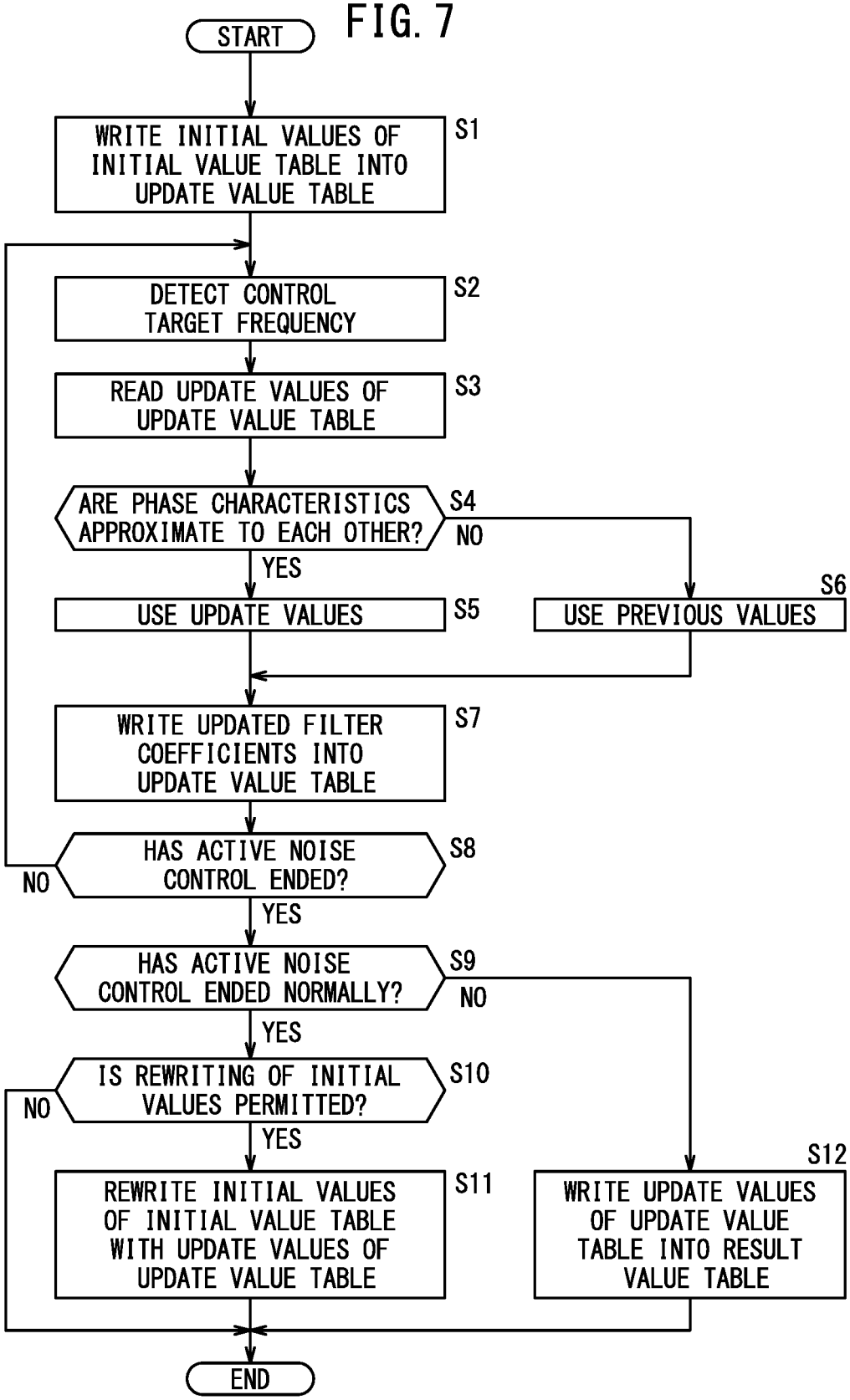
FIG. 7 is a flowchart illustrating a flow of a filter coefficient update process.

FIG. 7 is a flowchart showing a flow of update processing of the filter coefficients C0ˆ and C1ˆ. The process of updating the filter coefficients C0ˆ and C1ˆ is executed each time active noise control is performed.

In step S1, the update value table operating unit 64 writes the initial values stored in the initial value table 56 into the update value table 58 as update values ((A) of FIG. 6). That is, the update value table operating unit 64 writes the initial values corresponding to each frequency into the update value table 58 as the update value corresponding to each frequency. Thereafter, the process proceeds to step S2.

In step S2, the frequency detecting circuit 26*a* provided in the signal processing unit 54 detects the control target frequency f. Thereafter, the process proceeds to step S3.

In step S3, the secondary path filter coefficient updating unit 40 reads update values corresponding to the control target frequency f ((B) of FIG. 6). Thereafter, the process proceeds to step S4.

In step S4, the secondary path filter coefficient updating unit 40 determines whether or not the phase characteristic of the previous value secondary path filter Cˆ and the phase characteristic of the update value secondary path filter Cˆ are approximate to each other. When it is determined that the phase characteristic of the previous value secondary path filter Cˆ and the phase characteristic of the update value secondary path filter Cˆ are approximate to each other, the process proceeds to step S5. In a case where it is determined that the phase characteristic of the previous value secondary path filter Cˆ and the phase characteristic of the update value secondary path filter Cˆ are not approximate to each other, the process proceeds to step S6.

In step S5, the secondary path filter coefficient updating unit 40 updates the filter coefficients C0ˆ and C1ˆ by inputting the update values corresponding to the control target frequency f at the time of this updating to the pre-update values of the update expressions. Thereafter, the process proceeds to step S7.

In step S6, the secondary path filter coefficient updating unit 40 updates the filter coefficients C0ˆ and C1ˆ by inputting the filter coefficients C0ˆ and C1ˆ after the previous updating to the pre-update values of the update expressions. Thereafter, the process proceeds to step S7.

In step S7, the update value table operating unit 64 writes the updated filter coefficients C0ˆ and C1ˆ into the update values corresponding to the control target frequency f in the update value table 58 ((C) of FIG. 6). Thereafter, the process proceeds to step S8.

In step S8, the termination state determination unit 68 determines whether or not the active noise control has ended. If the active noise control has not ended, the process returns to step S2, and if the active noise control has ended, the process proceeds to step S9.

In step S9, the termination state determination unit 68 determines whether or not the active noise control has ended normally. If it is determined that the active noise control has ended normally, the process proceeds to step S10. If it is determined that the active noise control has abnormally ended or ended in divergence, the process proceeds to step S12.

In step S10, the initial value table operating unit 62 determines whether or not rewriting of the initial values of the initial value table 56 is permitted. If rewriting of the initial value table 56 is permitted, the process proceeds to step S11. When rewriting of the initial value table 56 is not permitted, the update processing of the filter coefficients C0ˆ and C1ˆ is ended.

In step S11, the initial value table operating unit 62 rewrites the initial values corresponding to the frequency of the initial value table 56 with the update values corresponding to the frequency of the update value table 58 ((D) of FIG. 6). Then, the update processing of the filter coefficients C0ˆ and C1ˆ is ended.

In step S12, the result value table operating unit 66 writes the update values corresponding to the frequency of the update value table 58 into the result values corresponding to the frequency of the result value table 60 ((E) of FIG. 6). Then, the update processing of the filter coefficients C0ˆ and C1ˆ is ended.

The initial value table 56 and the result value table 60 can be copied to a personal computer or the like connected to the vehicle 12. Therefore, when an abnormality or divergence occurs in the active noise control, the cause of the occurrence of the abnormality or divergence in the active noise control can be verified by comparing the update value stored in the initial value table 56 with the result value stored in the result value table 60.

Operational Effects

The secondary path characteristic C differs depending on the frequency of the canceling sound. In order to identify the secondary path characteristic C more accurately, it is necessary to update the filter coefficients C0ˆ and C1ˆ of the secondary path filter Cˆ for each of the frequencies of the canceling sound.

In the present embodiment, the active noise control device 10 is provided with the initial value table 56 and the update value table 58. As a result, the active noise control device 10 can set the initial values of filter coefficients C0ˆ and C1ˆ for respective frequencies. In addition, the active noise control device 10 can update filter coefficients C0ˆ and C1ˆ for each of frequencies using update values stored in update value table 58. Since the initial value is set for each frequency, the active noise control device 10 can significantly improve the initial silencing performance, particularly after the start of active noise control. Since filter coefficients C0ˆ and C1ˆ are updated for respective frequencies, the active noise control device 10 can identify secondary path characteristic C as secondary path filter Cˆ more accurately. As a result, the active noise control device 10 can improve silencing performance.

However, when the filter coefficients C0ˆ and C1ˆ are updated for each of the frequencies, the filter coefficients C0ˆ and C1ˆ corresponding to the frequencies corresponding to the engine rotational speed Ne having a low frequency of occurrence are updated a small number of times and learning progresses slowly. For this reason, the secondary path filter Cˆ may be largely deviated from the secondary path transfer characteristic C. In this case, problems such as a decrease in the silencing performance of the active noise control device 10 and output of abnormal sound from the speaker 16 may occur.

Hereinafter, an increase in sound pressure of noise by active noise control will be described with reference to FIGS. 8 and 9.

Figure 8:
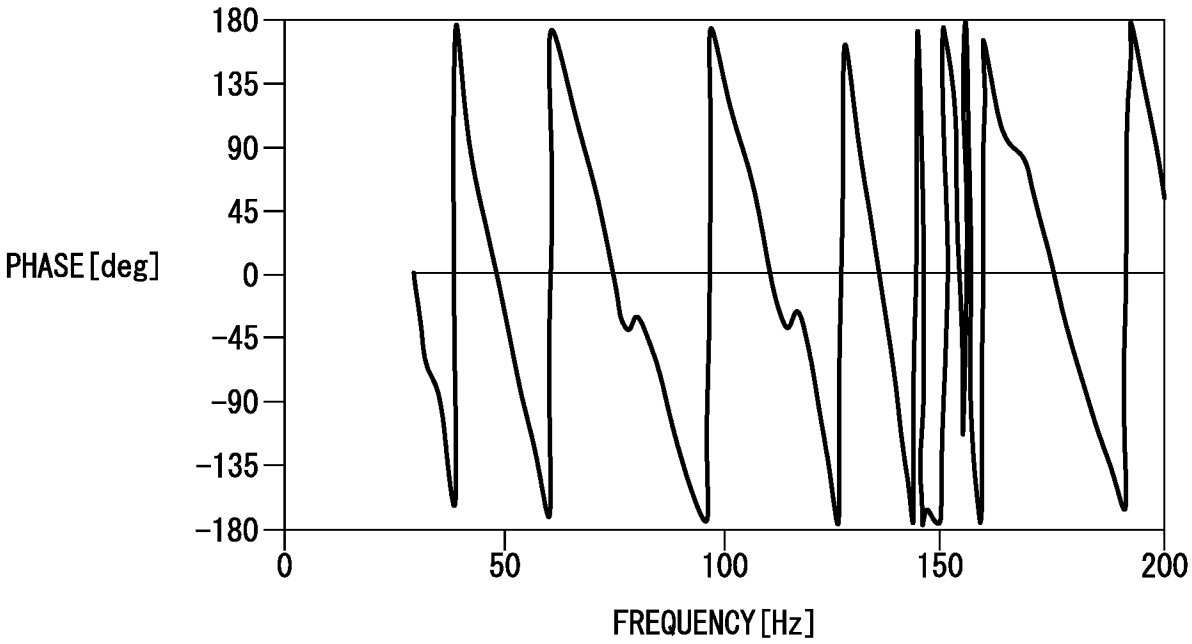
FIG. 8 is a graph showing a phase characteristic of a secondary path transfer characteristic and a phase characteristic of a secondary path filter.

FIG. 8 is a graph showing the phase characteristic of the secondary path transfer characteristic C and the phase characteristic of the secondary path filter Cˆ. In FIG. 8, a thick line indicates the phase characteristic of the secondary path transfer characteristic C, and a thin line indicates the phase characteristic of the secondary path filter Cˆ. Here, the phase characteristic of the secondary path filter Cˆ is set to 0° at all frequencies.

Figure 9:
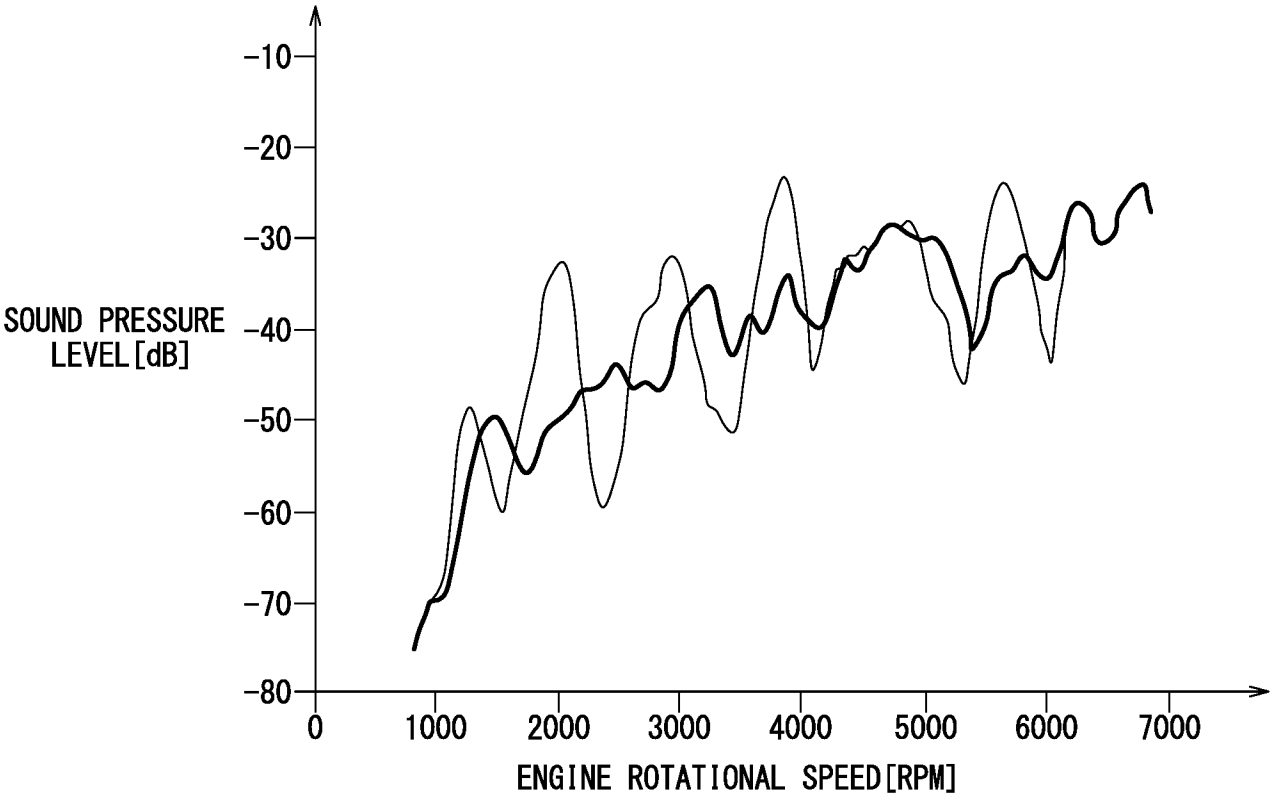
FIG. 9 is a graph illustrating sound pressure levels of noise in a vehicle compartment when active noise control is not performed and when active noise control is performed using the secondary path filter.

FIG. 9 is a graph showing the sound pressure level of noise in the vehicle compartment 14 when active noise control is not performed, and the sound pressure level of noise in the vehicle compartment 14 when active noise control is performed using the secondary path filter Cˆ of FIG. 8. In FIG. 9, a thick line indicates a sound pressure level when active noise control is not performed, and a thin line indicates a sound pressure level of noise when active noise control is performed using the secondary path filter Cˆ.

As illustrated in FIG. 8, the phase difference between the phase characteristic of the secondary path filter Cˆ and the phase characteristic of the actual secondary path transfer characteristic C is 180° at a frequency around 66 [Hz], a frequency around 100 [Hz], and a frequency around 130 [Hz]. A frequency around 66 [Hz] corresponds to an engine rotational speed around 2000 [RPM]. A frequency around 100 [Hz] corresponds to an engine rotational speed around 3000 [RPM]. A frequency around 130 [Hz] corresponds to an engine rotational speed around 3800 [RPM]. As shown in FIG. 9, the sound pressure level of the noise when the active noise control is performed is higher than the sound pressure level of the noise when the active noise control is not performed at the engine rotational speed around 2000 [RPM], the engine rotational speed around 3000 [RPM], and the engine rotational speed around 3800 [RPM].

The engine rotational speed Ne rarely increases or decreases rapidly. Further, as shown in FIG. 8, since the secondary path transfer characteristic C changes continuously with respect to a change in frequency, when the change in frequency is not rapid, the change in phase characteristic is also not rapid. In the secondary path transfer characteristic C, when the frequency changes by 1 [Hz], the phase characteristic does not change by 10° or more.

Therefore, when the learning of the update value of the update value table 58 is not advanced, the phase characteristic of the previous value secondary path filter Cˆ may be closer to the phase characteristic of the secondary path transfer characteristic C than the phase characteristic of the update value secondary path filter Cˆ.

Therefore, in the active noise control device 10 of the present embodiment, secondary path filter coefficient updating unit 40 determines whether or not the phase characteristic of update value secondary path filter Cˆ and the phase characteristic of previous value secondary path filter Cˆ are approximate to each other. Then, when it is determined that the phase characteristic of the update value secondary path filter Cˆ and the phase characteristic of the previous value secondary path filter Cˆ are approximate to each other, the secondary path filter coefficient updating unit 40 updates the filter coefficients C0ˆ and C1ˆ as follows. That is, the secondary path filter coefficient updating unit 40 updates the filter coefficients C0ˆ and C1ˆ by inputting the update values C0ˆ(f)_u and C1ˆ(f)_u corresponding to the control target frequency f to the pre-update values of the update expressions. On the other hand, when it is determined that the phase characteristic of the update value secondary path filter $C^{\wedge}$ is not approximate to the phase characteristic of the previous value secondary path filter $C^{\wedge}$, the secondary path filter coefficient updating unit 40 updates the filter coefficients $C0^{\wedge}$ and $C1^{\wedge}$ in the following manner. That is, the secondary path filter coefficient updating unit 40 updates the filter coefficients $C0^{\wedge}$ and $C1^{\wedge}$ by inputting the updated filter coefficients $C0^{\wedge}$ n and $C1^{\wedge}$ n at the previous time (time step n) to the pre-update values of the update expressions.

Figure 10:
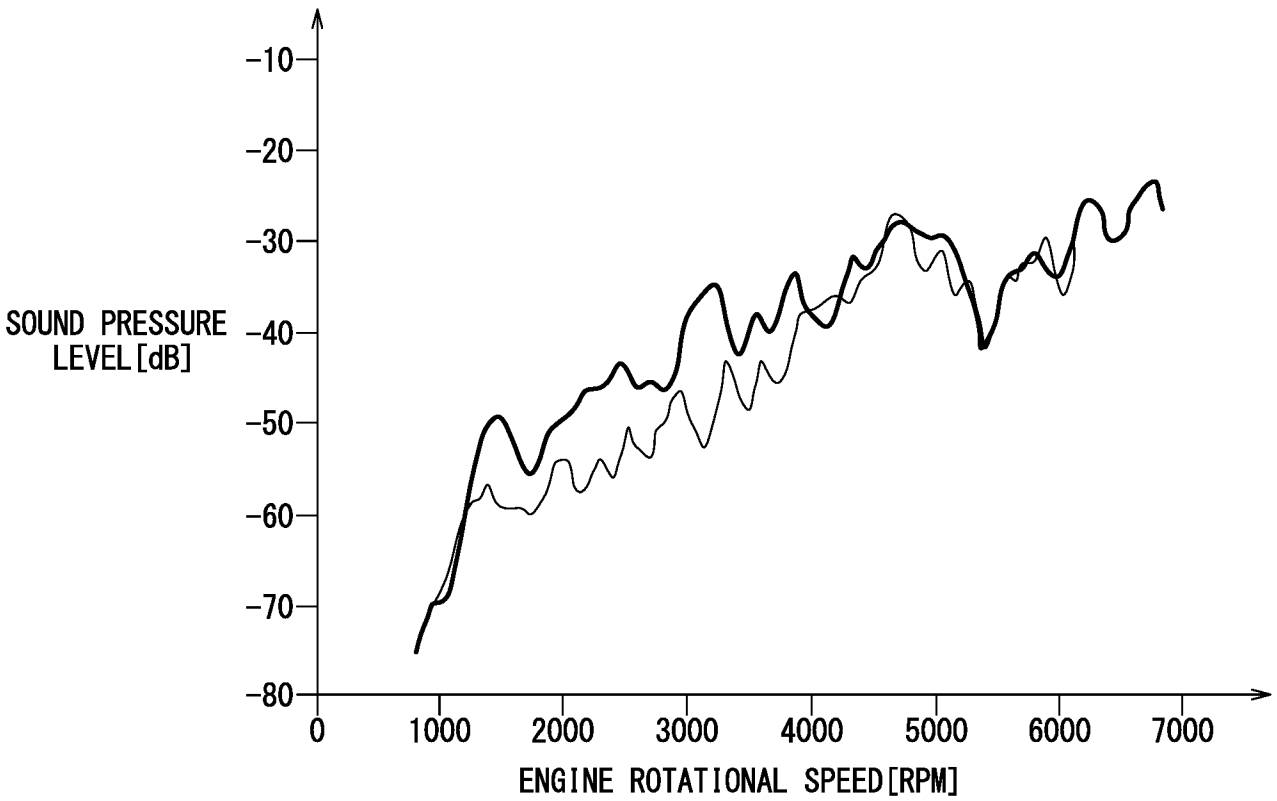
FIG. 10 is a graph illustrating sound pressure levels of noise in a vehicle cabin when active noise control is not performed and when active noise control is performed using a secondary path filter.

FIG. 10 is a graph showing a sound pressure level of noise in the vehicle compartment 14 in a case where the active noise control is not performed and a sound pressure level of noise in the vehicle compartment 14 in a case where the active noise control of the present embodiment is performed. In FIG. 10, a thick line indicates a sound pressure level when active noise control is not performed, and a thin line indicates a sound pressure level of noise when active noise control of the present embodiment is performed.

In the active noise control according to the present embodiment, it is possible to prevent the filter coefficients $C0^{\wedge}$ and $C1^{\wedge}$ of the secondary path filter $C^{\wedge}$, which have a characteristic greatly deviating from the secondary path transfer characteristic C, from being input to the pre-update values of the update expressions for the filter coefficients $C0^{\wedge}$ and $C1^{\wedge}$. As a result, as shown in FIG. 10, in the active noise control of the present embodiment, it is possible to suppress an increase in the sound pressure level of noise compared to a case where the active noise control is not performed.

The active noise control device 10 according to the present embodiment can improve the convergence performance of active noise control. Accordingly, the active noise control device 10 of the present embodiment can improve the initial noise reduction performance after the start of active noise control, and can suppress the generation of abnormal noise in vehicle compartment 14 even in a state where secondary path filter $C^{\wedge}$ is not converged. Furthermore, the active noise control device 10 of the present embodiment can improve quietness in the vehicle compartment 14 after the secondary path filter $C^{\wedge}$ has converged.

Further, in the active noise control device 10 of the present embodiment, secondary path filter coefficient updating unit 40 determines that the phase characteristic of previous value secondary path filter $C^{\wedge}$ and the phase characteristic of update value secondary path filter $C^{\wedge}$ are approximate to each other when phase difference θ between the phase characteristic of previous value secondary path filter $C^{\wedge}$ and the phase characteristic of update value secondary path filter $C^{\wedge}$ is less than 15°. Thus, in the active noise control device 10 of the present embodiment, it can be determined with high accuracy whether or not the phase characteristic of previous-value secondary path filter $C^{\wedge}$ and the phase characteristic of update value secondary path filter $C^{\wedge}$ are approximate to each other.

Further, in the active noise control device 10 of the present embodiment, secondary path filter coefficient updating unit 40 determines that the phase characteristic of previous value secondary path filter $C^{\wedge}$ and the phase characteristic of update value secondary path filter $C^{\wedge}$ are approximate to each other when update value secondary path filter $C^{\wedge}$ and previous value secondary path filter $C^{\wedge}$ are in the same region on the complex plane. Accordingly, the active noise control device 10 of the present embodiment can simplify the determination of whether or not the phase characteristic of previous value secondary path filter $C^{\wedge}$ and the phase characteristic of update value secondary path filter $C^{\wedge}$ are approximate to each other.

Other Embodiments

In the first embodiment, the active noise control device 10 includes the initial value table 56 and the update value table 58, but need not necessarily include update value table 58. In this case, the secondary path filter coefficient updating unit 40 determines whether or not the phase characteristic of the previous secondary path filter $C^{\wedge}$ and the phase characteristic of the secondary path filter $C^{\wedge}$ having the initial value as a coefficient are approximate to each other. The initial value is a value corresponding to the control target frequency f stored in the initial value table 56. When it is determined that the phase characteristic of the previous secondary path filter $C^{\wedge}$ and the phase characteristic of the secondary path filter $C^{\wedge}$ having the initial value as a coefficient are approximate to each other, the secondary path filter coefficient updating unit 40 inputs the initial values of the initial value table 56 to the pre-update values of the update expressions and updates the filter coefficients $C0^{\wedge}$ and $C1^{\wedge}$. When it is determined that the phase characteristic of the previous secondary path filter $C^{\wedge}$ is not approximate to the phase characteristic of the secondary path filter $C^{\wedge}$ having the initial value as a coefficient, the secondary path filter coefficient updating unit 40 updates the filter coefficients $C0^{\wedge}$ and $C1^{\wedge}$ by inputting the updated filter coefficients $C0^{\wedge}$ and $C1^{\wedge}$ to the pre-update values of the update expressions. Every time the filter coefficients $C0^{\wedge}$ and $C1^{\wedge}$ are updated, the initial value table operating unit 62 rewrites the initial values of the initial value table 56 to the updated filter coefficients $C0^{\wedge}$ and $C1^{\wedge}$.

Technical Ideas Obtained from Embodiments

A description will be given below concerning technical concepts that are capable of being grasped from the above-described embodiments.

The active noise control device (10) performs active noise control for controlling the speaker (16), based on an error signal that changes in accordance with a synthetic sound of noise transmitted from a vibration source and a canceling sound output from the speaker to cancel the noise, and includes the basic signal generating unit (26) configured to generate a basic signal corresponding to a control target frequency, the control signal generating unit (28) configured to perform signal processing on the basic signal by a control filter, which is an adaptive notch filter, to generate a control signal that controls the speaker, the estimated noise signal generating unit (32) configured to perform signal processing on the basic signal by a primary path filter, which is an adaptive notch filter, to generate an estimated noise signal, the first estimated cancellation signal generating unit (30) configured to perform signal processing on the control signal by a secondary path filter, which is an adaptive notch filter, to generate a first estimated cancellation signal, the first virtual error signal generating unit (46) configured to generate a first virtual error signal from the error signal, the first estimated cancellation signal, and the estimated noise signal, and the secondary path filter coefficient updating unit (40) configured to sequentially and adaptively update a coefficient of the secondary path filter based on the control signal and the first virtual error signal in a manner that a magnitude of the first virtual error signal is minimized, and the initial value table (56) configured to store an initial value of the coefficient of the secondary path filter in table form in association with a frequency, wherein the secondary path filter coefficient updating unit is configured to determine, before updating the coefficient of the secondary path filter, whether or not a phase characteristic of the secondary path filter when the initial value corresponding to the frequency in the initial value table is the coefficient of the secondary path filter and a phase characteristic of the secondary path filter after previous coefficient updating in the secondary path filter coefficient updating unit, are approximate to each other, update, when the phase characteristics are determined to be approximate, the coefficient of the secondary path filter by using the initial value as a previous value, and update, when the phase characteristics are determined not to be approximate, the coefficient of the secondary path filter by using the coefficient of the secondary path filter after the previous coefficient updating as a previous value by the secondary path filter coefficient updating unit.

In the active noise control device, if a phase difference between the phase characteristic of the secondary path filter when the initial value corresponding to the frequency in the initial value table is the coefficient of the secondary path filter and the phase characteristic of the secondary path filter after the previous coefficient updating in the secondary path filter coefficient updating unit, is less than a predetermined angle, the secondary path filter coefficient updating unit may be configured to determine that the phase characteristic of the secondary path filter when the initial value corresponding to the frequency in the initial value table is the coefficient of the secondary path filter and the phase characteristic of the secondary path filter after the previous coefficient updating in the secondary path filter coefficient updating unit are approximate to each other.

In the active noise control device, if, when a complex plane is divided into a plurality of regions at predetermined angles, the phase characteristic of the secondary path filter when the initial value corresponding to the frequency in the initial value table is the coefficient of the secondary path filter and the phase characteristic of the secondary path filter after the previous coefficient updating in the secondary path filter coefficient updating unit are in the same region, it may be determined that the phase characteristic of the secondary path filter when the initial value corresponding to the frequency in the initial value table is the coefficient of the secondary path filter and the phase characteristic of the secondary path filter after the previous coefficient updating in the secondary path filter coefficient updating unit are approximate to each other.

The active noise control device may include the update value table (58) configure to store an update value of the coefficient of the secondary path filter in table form in association with the frequency, and the update value table operating unit (64) configured to write the initial value of the initial value table as the update value in the update value table when the active noise control is started, and write the coefficient of the secondary path filter updated by the secondary path filter coefficient updating unit as the update value in the update value table during the active noise control, wherein the secondary path filter coefficient updating unit may be configured to determine, before updating the coefficient of the secondary path filter, whether or not the phase characteristic of the secondary path filter when the update value corresponding to the frequency in the update value table is the coefficient of the secondary path filter and a phase characteristic of the secondary path filter after previous coefficient updating in the secondary path filter coefficient updating unit are approximate to each other, update, when the phase characteristics are determined to be approximate, the coefficient of the secondary path filter by using the update value as a previous value, and update, when the phase characteristics are determined not to be approximate, the coefficient of the secondary path filter by using the coefficient of the secondary path filter after the previous coefficient updating as a previous value by the secondary path filter coefficient updating unit.

The active noise control device may include the initial value table operating unit (62) configured to rewrite the initial value of the initial value table with the update value of the update value table when the active noise control terminates.

The active noise control device may include the reference signal generating unit (34) configured to perform signal processing on the basic signal by the secondary path filter to generate a reference signal, the second estimated cancellation signal generating unit (36) configured to perform signal processing on the reference signal by the control filter to generate a second estimated cancellation signal, the second virtual error signal generating unit (52) configured to generate a second virtual error signal from the second estimated cancellation signal and the estimated noise signal, the control filter coefficient updating unit (42) configured to sequentially and adaptively update a coefficient of the control filter based on the reference signal and the second virtual error signal in a manner that a magnitude of the second virtual error signal is minimized, and the primary path filter coefficient updating unit (38) configured to sequentially and adaptively update a coefficient of the primary path filter based on the basic signal and the first virtual error signal in a manner that a magnitude of the first virtual error signal is minimized.

The present invention is not particularly limited to the embodiments described above, and various modifications are possible without departing from the essence and gist of the present invention.

What is claimed is:

1. An active noise control device that performs active noise control for controlling a speaker, based on an error signal that changes in accordance with a synthetic sound of noise transmitted from a vibration source and a canceling sound output from the speaker to cancel the noise, the active noise control device comprising one or more processors that execute computer-executable instructions stored in a memory, wherein the one or more processors execute the computer-executable instructions to cause the active noise control device to:

generate a basic signal corresponding to a control target frequency;

perform signal processing on the basic signal by a control filter, which is an adaptive notch filter, to generate a control signal that controls the speaker;

perform signal processing on the basic signal by a primary path filter, which is an adaptive notch filter, to generate an estimated noise signal;

perform signal processing on the control signal by a secondary path filter, which is an adaptive notch filter, to generate a first estimated cancellation signal;

generate a first virtual error signal from the error signal, the first estimated cancellation signal, and the estimated noise signal;

sequentially and adaptively update a coefficient of the secondary path filter based on the control signal and the first virtual error signal in a manner that a magnitude of the first virtual error signal is minimized;

store in an initial value table an initial value of the coefficient of the secondary path filter in table form in association with a frequency, determine, before updating the coefficient of the secondary path filter, whether or not a phase characteristic of the secondary path filter when the initial value corresponding to the frequency in the initial value table is the coefficient of the secondary path filter and a phase characteristic of the secondary path filter after previous coefficient updating, are approximate to each other;

update, when the phase characteristics are determined to be approximate, the coefficient of the secondary path filter by using the initial value as a previous value; and update, when the phase characteristics are determined not to be approximate, the coefficient of the secondary path filter by using the coefficient of the secondary path filter after the previous coefficient updating as a previous value.

2. The active noise control device according to claim 1, wherein if a phase difference between the phase characteristic of the secondary path filter when the initial value corresponding to the frequency in the initial value table is the coefficient of the secondary path filter and the phase characteristic of the secondary path filter after the previous coefficient updating, is less than a predetermined angle, the one or more processors cause the active noise control device to determine that the phase characteristic of the secondary path filter when the initial value corresponding to the frequency in the initial value table is the coefficient of the secondary path filter and the phase characteristic of the secondary path filter after the previous coefficient updating are approximate to each other.

3. The active noise control device according to claim 1, wherein if, when a complex plane is divided into a plurality of regions at predetermined angles, the phase characteristic of the secondary path filter when the initial value corresponding to the frequency in the initial value table is the coefficient of the secondary path filter and the phase characteristic of the secondary path filter after the previous coefficient updating are in a same region, the one or more processors cause the active noise control device to determine that the phase characteristic of the secondary path filter when the initial value corresponding to the frequency in the initial value table is the coefficient of the secondary path filter and the phase characteristic of the secondary path filter after the previous coefficient updating are approximate to each other.

4. The active noise control device according to claim 1, wherein the one or more processors cause the active noise control device to:

store in an update value table an update value of the coefficient of the secondary path filter in table form in association with the frequency; and write the initial value of the initial value table as the update value in the update value table when the active noise control is started, and write the updated coefficient of the secondary path filter as the update value in the update value table during the active noise control, determine, before updating the coefficient of the secondary path filter, whether or not the phase characteristic of the secondary path filter when the update value corresponding to the frequency in the update value table is the coefficient of the secondary path filter and a phase characteristic of the secondary path filter after previous coefficient updating are approximate to each other;

update, when the phase characteristics are determined to be approximate, the coefficient of the secondary path filter by using the update value as a previous value; and update, when the phase characteristics are determined not to be approximate, the coefficient of the secondary path filter by using the coefficient of the secondary path filter after the previous coefficient updating as a previous value.

5. The active noise control device according to claim 4, wherein the one or more processors cause the active noise control device to rewrite the initial value of the initial value table with the update value of the update value table when the active noise control terminates.

6. The active noise control device according to claim 1, wherein the one or more processors cause the active noise control device to:

perform signal processing on the basic signal by the secondary path filter to generate a reference signal;

perform signal processing on the reference signal by the control filter to generate a second estimated cancellation signal;

generate a second virtual error signal from the second estimated cancellation signal and the estimated noise signal;

sequentially and adaptively update a coefficient of the control filter based on the reference signal and the second virtual error signal in a manner that a magnitude of the second virtual error signal is minimized; and sequentially and adaptively update a coefficient of the primary path filter based on the basic signal and the first virtual error signal in a manner that a magnitude of the first virtual error signal is minimized.

* * * * *